US005934217A

United States Patent [19]

Allsop

[11] Patent Number: 5,934,217

[45] Date of Patent: Aug. 10, 1999

[54] COLLAPSIBLE, STOWABLE BOOM AND PYLON DEVICE FOR WATERCRAFT

[76] Inventor: Douglas L. Allsop, 42 E. 900 South, Mapleton, Utah 84664

[21] Appl. No.: 08/890,126

[22] Filed: Jul. 9, 1997

[51] Int. Cl.[6] ..... B63B 21/56

[52] U.S. Cl. ..... 114/242; 114/253

[58] Field of Search ..... 114/242, 250, 114/253, 254

[56] References Cited

U.S. PATENT DOCUMENTS

| | | | |
|---|---|---|---|
| 3,303,813 | 2/1967 | Collins et al. | 114/254 |
| 3,326,175 | 6/1967 | Baker | 114/254 |
| 3,602,188 | 8/1971 | Penaflor | 114/253 |
| 3,949,698 | 4/1976 | Sell . | |
| 4,304,189 | 12/1981 | Wright . | |
| 4,589,366 | 5/1986 | Eiber . | |
| 4,641,597 | 2/1987 | Paxton . | |
| 4,738,414 | 4/1988 | McCulloh . | |
| 4,893,577 | 1/1990 | Jennings . | |
| 5,000,109 | 3/1991 | Anderson . | |
| 5,241,921 | 9/1993 | Sadlak . | |

*Primary Examiner*—Sherman Basinger
*Attorney, Agent, or Firm*—Clayton, Howarth & Cannon, P.C.

[57] ABSTRACT

A towing device for towing a water sporter as part of a watersporting activity. An elongate towing member is collapsibly stowed within a storage housing secured to the bottom of a watercraft. The storage housing extends upwardly from the bottom of the boat in a nominally vertical direction. The towing member remains in an unextended orientation to operate as a pylon towing device. If additional height of the pylon is desired, the towing member is selectively extended in length to an elevated height and thereby operates as a elevated pylon. The extended pylon, or elevated pylon, can be shifted to a lateral, sideways extending position so that it terminates in a distal end reaching across the side of the watercraft in a cantilevered orientation for use as a boom tow.

40 Claims, 4 Drawing Sheets

COLLAPSIBLE, STOWABLE BOOM AND PYLON DEVICE FOR WATERCRAFT

BACKGROUND OF THE INVENTION

1. The Field of the Invention

The present invention relates generally to booms and pylons used for water sports activities. More particularly, it concerns a selectively extendable and retractable pylon that is shiftable between a pylon position and a boom position.

2. The Background Art

It is known in the prior art to provide motorized watercraft with various booms and pylons to assist in water sports activities. The term "water sport" as used herein shall refer generally to water activities accomplished through the use of watercraft, including, but not limited to, wake boarding, knee boarding, water skiing, barefoot water skiing, and any other water sport activity utilizing a tow rope and watercraft. The phrase "water sporter" refers to one who engages in water sports. Some of the prior art devices are shown in FIG. 1, which illustrates a motorized watercraft designated generally at 10. FIG. 1 depicts three separate accessory devices, namely, a pylon 12, a taller pylon or "elevated pylon" 14 shown in phantom line, and a laterally-extending boom 16, also in phantom line.

The pylon 12 is used to support a tow rope (not shown in FIG. 1) at attachment point 22 pulling a water sporter during normal water-sporting activities. More adventurous water sporters who enjoy negotiating the wake of turbulent water or ramping devices will be launched into the air as they water ski, and they often use the elevated pylon 14 whereby the tow rope would be attached at the higher attachment point 24 to accommodate the launch. Less adventurous or novice water sporters often prefer to use the side boom 16 which extends rigidly sideways from the side 20 of the watercraft 10. The water sporter simply grasps the boom 16 to obtain support in the vertical dimension or attaches a short rope or yoke to the boom 16.

Examples of prior art pylon towing devices are shown in U.S. Pat. Nos. 4,893,577 (granted Jan. 16, 1990 to Jennings) and 4,641,597 (granted Feb. 10, 1987 to Paxton). An example of a conventional boom assembly is shown in U.S. Pat. No. 5,000,109 (granted Mar. 19, 1991 to Anderson).

The elevated pylon 14 and the boom 16 are normally stored in the bottom or side of the boat. If a user desires to use the elevated pylon 14, it is retrieved from the bottom or side of the boat and placed over the pylon 12 and secured thereto. Similarly, if a user desires to use the boom 16, the boom is then retrieved from the bottom or side of the boat and attached at attachment point 18 to the pylon. The boom extends over the side 20 of the boat in a laterally-extended sideways position as shown in FIG. 1. Accordingly, the thinking in the prior art has been limited to an approach of adding separate structural accessories for each towing function. Water sporters wanted a laterally extending boom, so the industry responded with a structural member for that function as well. Water sporters wanted a taller pylon, so the industry again responded with an additional structural member.

The unfortunate byproduct of this thinking has been an encumbrance of the already limited storage space in the watercraft. These various accessories also take up valuable space when they are detached and stored in the boat during periods of nonuse. Another disadvantage is that the various pylon, elevated pylon and boom accessories can be cumbersome, laborious and time-consuming to attach and remove.

OBJECTS AND SUMMARY OF THE INVENTION

It is therefore an object of the present invention to provide a towing device for water sporting that is less cumbersome, laborious and time-consuming to use, attach or remove.

It is another object of the invention, in accordance with one aspect thereof, to provide such a towing device that is selectively extendable and collapsible, and also stowable in a vertically extending storage space in a watercraft.

It is a further object of the invention, in accordance with one aspect thereof, to provide such a towing device that can function as a pylon, elevated pylon or boom.

The above objects, and others not specifically recited, are realized in a specific illustrative embodiment of a towing device for towing a water sporter as part of a water sporting activity. An elongate towing member is collapsibly stowed within a storage housing secured to the bottom of a watercraft. The storage housing extends upwardly from the bottom of the boat in a vertical direction. The towing member remains in an unextended orientation to operate as a pylon towing device. If additional height of the pylon is desired, the towing member is selectively extended in length to an elevated height and thereby operates as a taller pylon. The taller or elevated pylon, can be shifted from the vertical position to a lateral, sideways extending position so that it terminates in a distal end reaching across the side of the watercraft in a cantilevered orientation for use as a boom tow.

Additional objects and advantages of the invention will be set forth in the description which follows, and in part will be apparent from the description, or may be learned by the practice of the invention without undue experimentation. The objects and advantages of the invention may be realized and obtained by means of the instruments and combinations particularly pointed out in the appended claims.

BRIEF DESCRIPTION OF THE DRAWINGS

The above and other objects, features and advantages of the invention will become apparent from a consideration of the subsequent detailed description presented in connection with the accompanying drawings in which.

DETAILED DESCRIPTION OF PRESENTLY PREFERRED EMBODIMENTS

Figure 1:
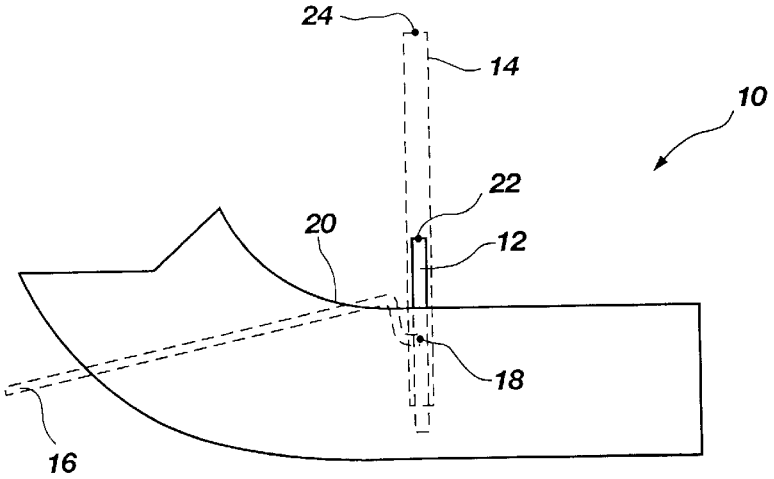
Fig. 1 (PRIOR ART)
FIG. 1 is a side, schematic view of various water sport towing devices known in the prior art.

For the purposes of promoting an understanding of the principles in accordance with the invention, reference will now be made to the embodiments illustrated in the drawings and specific language will be used to describe the same. It will nevertheless be understood that no limitation of the scope of the invention is thereby intended. Any alterations and further modifications of the illustrated apparatus, and any additional applications of the principles of the invention as illustrated herein, which would normally occur to one skilled in the relevant art and possessed of this disclosure, are to be considered within the scope of the invention claimed.

Applicant has discovered that a single water sport towing device can be constructed to provide the multi-purpose functions of a pylon, extended pylon or "elevated pylon," and a laterally extending boom. The concept is embodied in a pylon device that is selectively extendable into a vertically elevated "elevated pylon" position, or into a horizontally extended "boom" position such that the distal end of the device terminates in a cantilevered orientation across the side of the watercraft.

Figure 2:
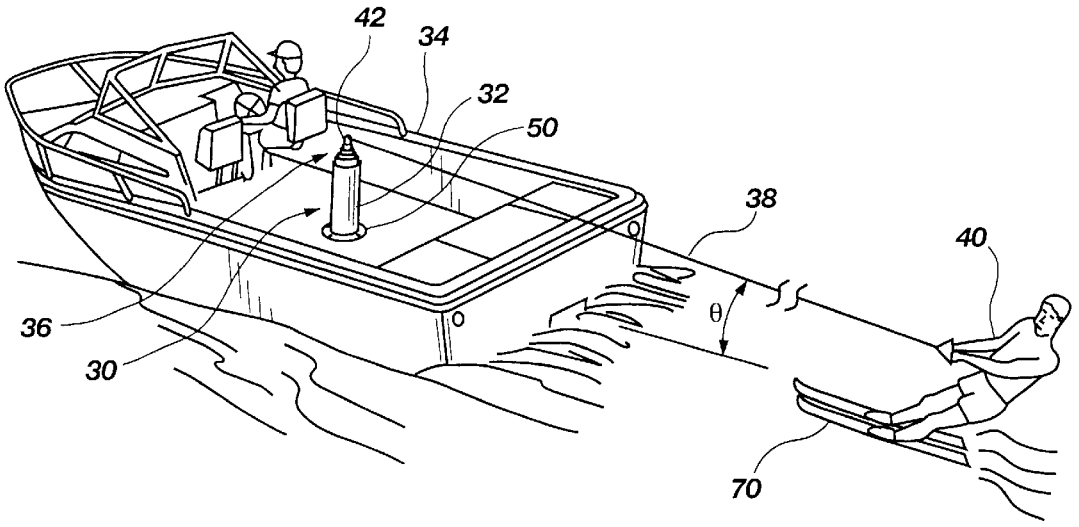
FIG. 2 is a perspective view of an extendable pylon towing device, made in accordance with the principles of the present invention.
Figure 3:
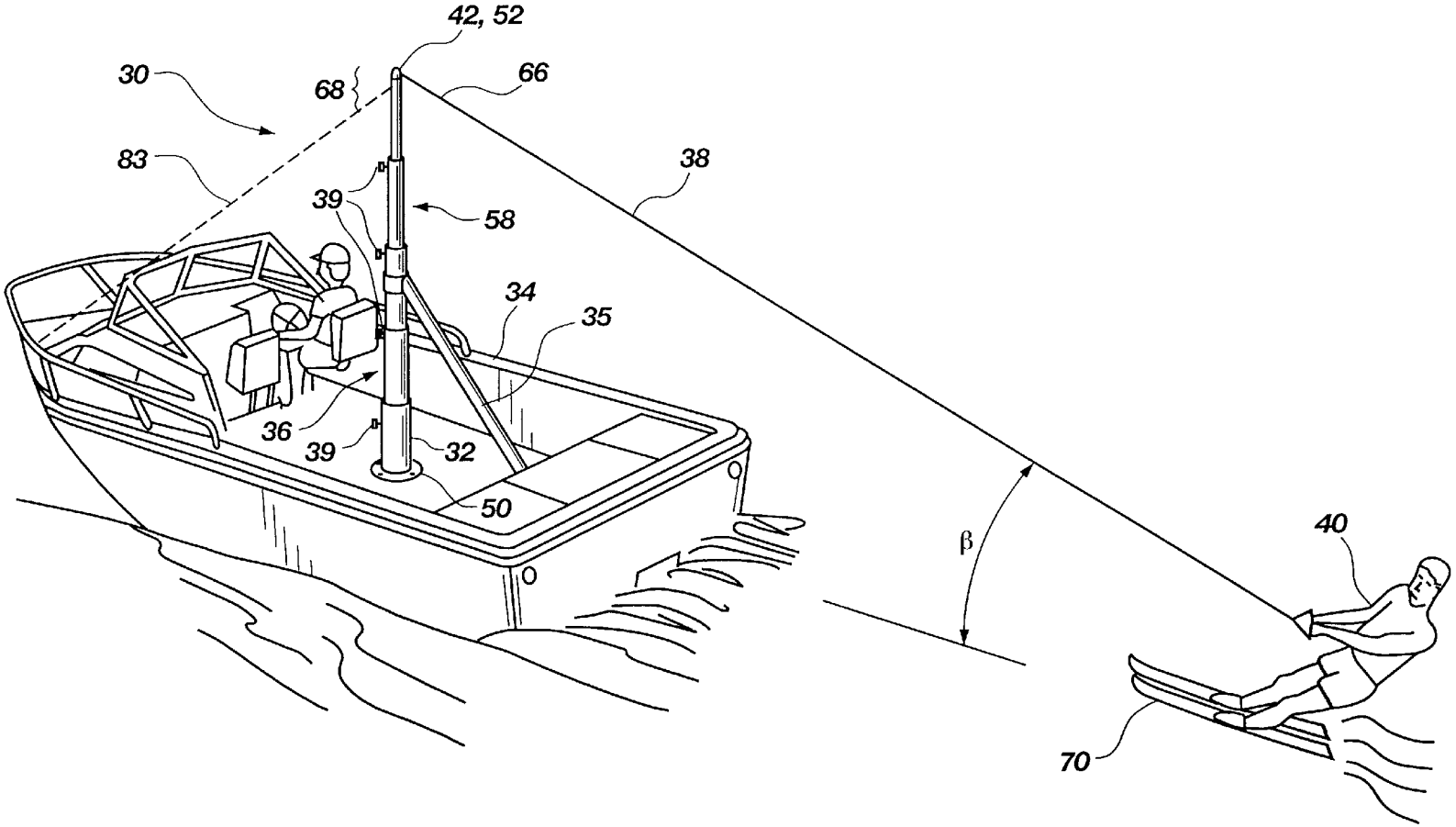
FIG. 3 is a perspective view of the pylon towing device of FIG. 2 in a vertically extended position.
Figure 4A:
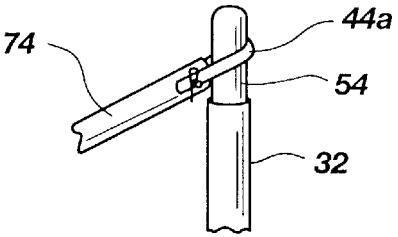
FIG. 4A is a partial, break-away view of an alternative position-shifting apparatus.
Figure 4B:
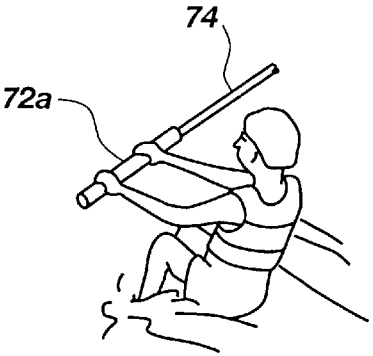
FIG. 4B is a partial, break-away view of an alternative design of an end section of the towing member.
Figure 4:
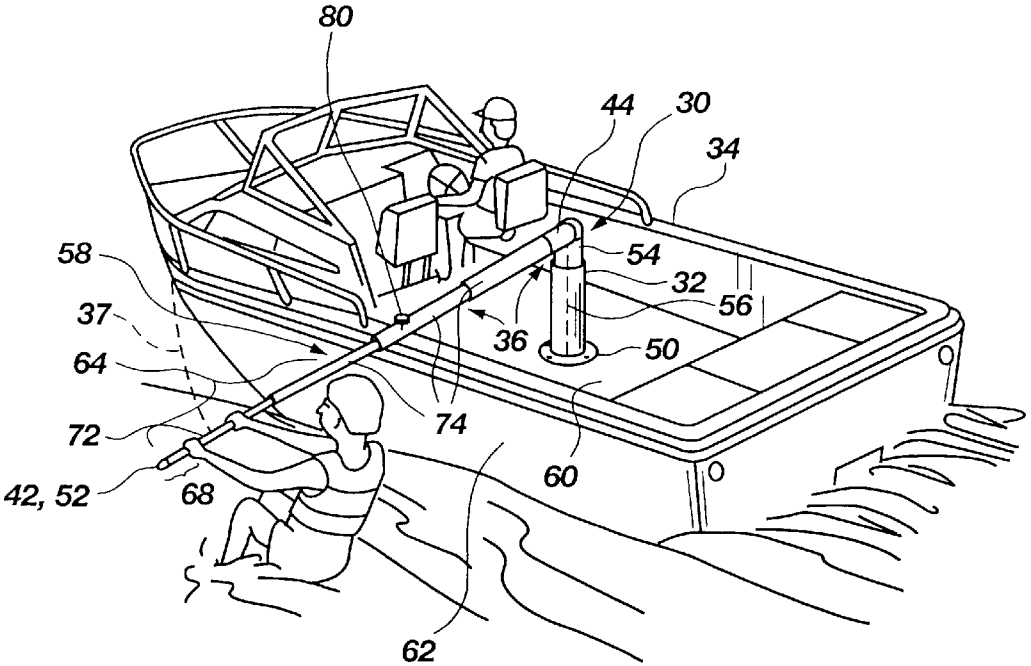
FIG. 4 is a perspective view of the pylon towing device of FIG. 2 in a horizontally extended position.

Referring now to FIGS. 2–4, there is shown a water sport towing device, designated generally at 30, made in accordance with the principles of the present invention. The towing device 30 includes a storage support member 32 secured to the watercraft 34. An elongate towing member, designated generally at 36, is stowed in the storage member 32 in an unextended position as shown in FIG. 2. The towing member 36 operates as a conventional pylon when in its unextended position, for pulling a tow line 38 in tension while towing a water sporter 40. The tow line 38 is secured to the towing member 36 at a first attachment point 42.

The elongate towing member 36 is extendable, preferably telescopically, into an elevated pylon position as shown in FIG. 3. The extended orientation of the towing member 36 elevates the first attachment point 42 as well as the attached end 66 of the tow line 38. The elevated position of the tow line end 66 provides more upward pull, and as such can accommodate more adventurous water sporters who enjoy negotiating the wake of turbulent water or ramping devices to become launched into the air as they water sport. Preferably, a bracing means 35 is disposed to inter-connect the towing member 36 with the watercraft 34 and thereby counteract forces and moments imposed against the towing member 36 by the water sporter 40. The bracing means 35 comprises at least one member disposed in compression between the towing member 36 and the watercraft 34 when the tow line 38 is held in tension by the water sporter 40 being towed along the water surface 70. However, any suitable tension member or members shown in phantom line at 83, may also be used to support the towing member 36.

The towing member 36 is also shiftable into a horizontally extending position as shown in FIG. 4, for use as a boom. The water sporter 40 may simply grasp the cantilevered portion of the towing member 36, or attach a rope or yoke to said towing member 36, thereby obtaining support in the vertical dimension which is not provided by the tow line 38 of FIGS. 2–3. Any suitable coupling means 44, such as a pin or a pivot device, may be used to enable the towing member 36 to be shifted from the vertically extending position of FIG. 3 to the horizontally extending position of FIG. 4. For example, instead of a pivot device 44, a suitable clamping device 44*a* could be used as shown in FIG. 4A, for inter-coupling a section 74 of the towing member 36 to the base portion 54. Any suitable coupling means may be used to accomplish this function. Any suitable tension member or members, shown in phantom line at 37, can be secured to the watercraft 34 and the towing member 36 to provide support resistance to counteract the effects of the user holding onto the cantilevered portion 64.

Figure 5:
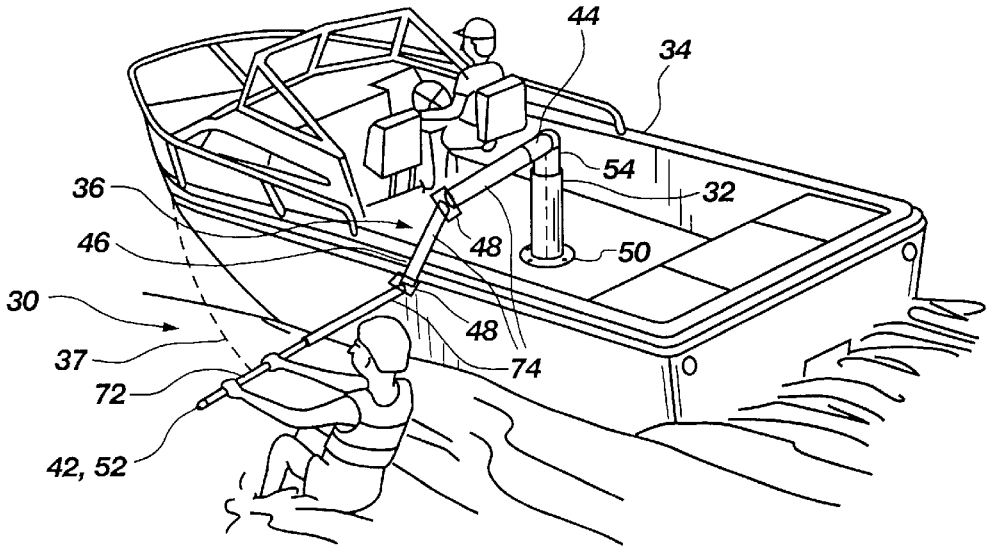
FIG. 5 is a perspective view of an alternative embodiment of the pylon towing device of FIG. 4, in an angled orientation.
Figure 5A:
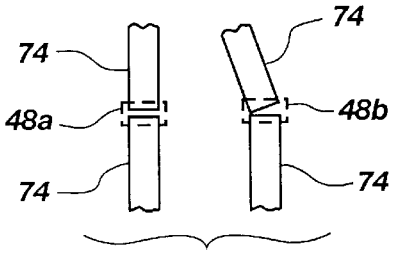
FIG. 5A is a partial, break-away view of an alternative angle-positioning apparatus.

The towing member 36 may optionally be configured and arranged to extend along an angled path, as shown in FIG. 5, for example. Railing structure 46, or some other encumbrance, such as a windshield or side glass of the watercraft 34, may reside in a straight, orthogonal path from the storage member 32, thereby inhibiting the straight, orthogonal orientation of the towing member 36 shown in FIG. 4. Couplers 48 can be incorporated as part of the towing member 36, to render the towing member 36 manually manipulable from the straight configuration of FIG. 4 into an angled configuration as shown in FIG. 5. In this manner the towing member 36 is able to extend around the railing (or other encumbering structure) 46 without altering a preferred position of stability of the storage housing 32. Any suitable angle-positioning means can be used as the couplers 48, for manipulating the towing member 36 between a straight orientation and an angled orientation, as desired. For example, in FIG. 5A is shown in phantom line couplers used in combination with a budding end portion of opposing mid-section 74 of the towing member 36 which have been configured and shaped to be rotatably adjustable from a first, generally straight body at 48*a,* and a second, angled-position shown at 48*b*.

The more technical details of the present invention shall now be described. Referring in particular to FIGS. 3–4, the towing device 30 comprises the elongate towing member 36, a first attachment means 50 for attaching the storage housing 32 to the bottom of the watercraft 34, and a second attachment means 52 for attaching the tow line 38 to the towing member 36.

The elongate towing member 36 comprises an elongate base portion 54 defining a longitudinal direction 56, an elongate upper portion designated generally at 58, and the coupling means 44 for movably coupling said upper portion 58 to said base portion 54 in a manner sufficient to render said upper portion 58 moveable relative to the base portion 54 from a first, vertical position (FIG. 3) to a second, lateral position (FIG. 4), wherein said base portion 54 and upper portion 58 collectively define a substantially straight line when said upper portion 58 is disposed in said first position, and wherein said upper portion 58 extends laterally sideways from said base portion 54 in the second, lateral position.

The first attachment means 50 operates to (i) intercouple the base portion 54 of the towing member 36 with an interior portion 60 of the watercraft 34 such that said base portion 54 extends upwardly from said interior portion 60 along the longitudinal direction 56, and (ii) positioning said base portion 54 and upper portion 58 such that said upper portion 58 extends from said base portion 54 across a side 62 of the watercraft 34 and terminates in a cantilevered section 64 extending from said side 62 of the watercraft 34 when said upper portion 58 resides in the second, lateral position.

The second attachment means 52 operates to attach a first end 66 of the tow line 38 to the first attachment point 42 on a distal end section 68 the towing member 36 and pulling said tow line 38 in tension as said tow line 38 is held by the water sporter 40 to thereby tow said water sporter 40 along a water surface 70.

The upper portion 58 of the towing member 38 has a first, unextended length (as shown in FIG. 2), and the coupling means 44 further comprises lengthening means for lengthening said upper portion 58 to a second, extended length (as shown in FIG. 3) to thereby provide an elevated alternative for the first attachment point 42 and first end 66 of the tow line 38 when said upper portion 58 resides in the first position (as shown in FIG. 3) such that the tow line 38 defines a towing angle β relative to the water surface 70 when said tow line 38 is held in tension by the water sporter 40 being towed along the water surface 70, said towing angle β producing a smaller downward component of force in the tow line 38 (or a larger upward component)than it would at angle θ in FIG. 2 when said upper portion 58 is disposed in its first, unextended length. The lengthening means may comprise, for example, open ends of a plurality of individual sections of the towing means 36, as well as pin members 39, locking sleeves or other suitable means for holding the individual sections in a lengthened configuration as shown in FIG. 3.

The base of the towing member 36 further comprises, in addition to the base portion 54, a one-piece, unitary hollow storing and support means 32 for storing and supporting the upper portion 58 of the towing means 36 therein such that at least a majority length of said upper portion 58 resides inside said storing means 32 when said upper portion 58 is disposed in its first, unextended length, as shown in FIG. 2.

The base can also be described as follows. A first end section 54 with the upper portion 58 of the towing member 36 comprising an opposing second end section 72 and a plurality of mid-sections 74, and wherein the coupling means further comprises the couplers 48 for movably coupling the sections 54, 72 and 74 to each other in series in a manner sufficient to render said mid-sections 74 and second end section 72 moveable relative to said first end section 54 from a first, straight position (as shown in FIG. 4) to a second, angled position (as shown in FIG. 5), wherein said mid-sections 74 and second end section 72 collectively define a substantially straight line when disposed in said first, straight position (as shown in FIG. 4), and wherein said mid-sections 74 and second end section 72 collectively extend sideways from the first end section 54 and define first and second non-straight angles in substantially a horizontal dimension when disposed position in the second, angled position shown in FIG. 5.

Figure 6A:
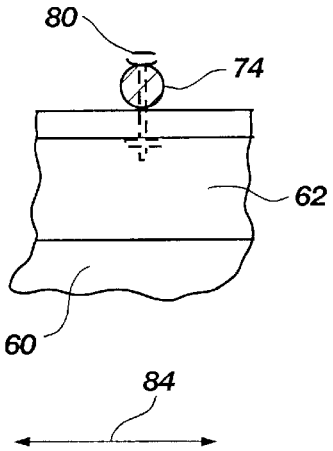
FIG. 6A is a partial, break-away view of a side portion of the watercraft showing attachment structure for securing the boom to the side of the watercraft.
Figure 6B:
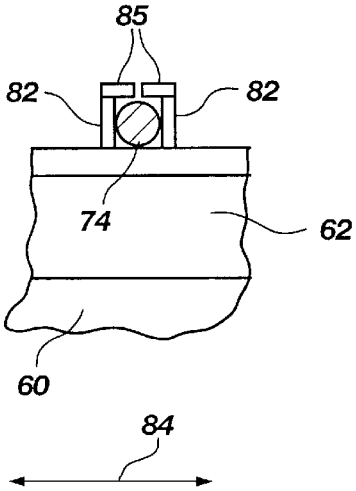
FIG. 6B is a partial, break-away view of an alternative embodiment of the attachment structure of FIG. 6A.

Referring now to FIG. 6A, the invention may optionally include a third attachment means 80 disposed on one of the mid-sections 74 for securing said mid-section 74 to the side 62 of the watercraft to thereby inhibit forward, backward and vertical movement of the upper portion 58 of the towing member 36 with respect to the watercraft, said forward and backward movement being depicted by arrow 84. The third attachment means 80 may comprise a bolt and nut apparatus to attach the mid-section 74 securely and immovably to the side 62 of the watercraft. Of course, the third attachment means may also comprise any suitable apparatus or means for preventing forward, backward and vertical movement of the towing member 36 as depicted by arrow 84. For example and in reference to FIG. 6B, the third attachment means may simply comprise a channel device 82 secured to the side 62 of the watercraft. The channel device 82 may include closing members 85 for closing off the channel to inhibit vertical displacement of the mid-section 74.

It will appreciated that users of the present invention as a boom-type apparatus may prefer that the distal ends section 72 have a minimum thickness for effective gripping with the hands. However, design constraints in constructing a telescopic series of sections as described herein may result in the distal end section 72 being narrower than desired. Therefore, referring now to FIG. 4B, it is within the scope of the present invention to design the elongate upper portion 58 such that it terminates in a second end (distal) portion 72*a* that is at least as wide as the mid-section 74 couple to said second end section 72*a,* said second end section 72A preferably being wider than said mid-section 74. This can be accomplished in any suitable manner, such as by securing an accessory attachment sleeve over the distal end 72, or by simply attaching the second end 72 as a separable member to begin with.

In accordance with the above description of the principles of the present invention, a preferred method of towing a water sporter as part of a water sporting activity, while utilizing an extendable pylon-type configuration, comprises the steps of:

(a) attaching an elongate towing member having a first, unextended length defining a longitudinal direction to an interior portion of a watercraft such that said towing member extends upwardly in the longitudinal direction, said towing member including a first attachment point thereon;

(b) attaching a first end of a tow line to the first attachment point on the towing member;

(c) advancing the watercraft along a water surface to thereby pull said tow line in tension as said tow line is held by a water sporter or tied to a watersporting apparatus, and tow said water sporter along the water surface; and (d) lengthening the elongate towing member in the longitudinal direction to a second, extended length to thereby elevate the first attachment point such that the tow line defines an angle relative to the water surface when said tow line is held in tension by a water sporter being towed along the water surface, said angle producing a smaller downward component of force in the tow line 38 (or a larger upward component) than it would have when said elongate towing member is disposed in its first, unextended length;

wherein said method is not limited to any order or sequence of the above steps.

A preferred method of towing a water sporter as part of a water sporting activity, with the capacity to alternate between a pylon-type configuration and an extendable boom-type configuration, comprises the steps of:

(a) attaching an elongate support member defining a longitudinal direction to an interior portion of a watercraft such that said support member extends upwardly in the longitudinal direction;

(b) attaching a towing member to the support member, said towing member including a first attachment point thereon;

(c) attaching a first end of a tow line to the first attachment point on the towing member;

(c) advancing the watercraft along a water surface to thereby pull said tow line in tension as said tow line is held by a water sporter and tow said water sporter along the water surface; and (d) lengthening the elongate towing member to a second, extended length to thereby move the first attachment point further away from the support member such that said towing member extends across a side of the watercraft and terminates in a cantilevered section extending from said side of the watercraft;

wherein said method is not limited to any order or sequence of the above steps.

It is to be understood that the present invention my be applied to any type of watercraft, and especially to non-inboard boats, and that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements.

What is claimed is:

1. A towing device for towing a water sporter as part of a water sport activity, said device comprising:

an elongate towing member comprising a base portion, an elongate upper portion, and coupling means for movably coupling said upper portion to said base portion in a manner sufficient to render said upper portion moveable relative to the base portion from a first, substantially vertical position to a second, lateral position, wherein said upper portion extends laterally sideways from said base portion in the second, lateral position;

first attachment means for (i) intercoupling the base portion of the towing member with an interior portion of a watercraft such that said base portion extends upwardly from said interior portion, and (ii) positioning said base portion and upper portion such that said upper portion extends from said base portion across a side of the watercraft and terminates in a cantilevered section extending from said side of the watercraft when said upper portion resides in the second, lateral position; and second attachment means for attaching a first end of a tow line to a first attachment point on a distal end section of the towing member and pulling said tow line in tension as said tow line is held by a water sporter or water sporting device to thereby tow said water sporter or water sporting device along a water surface when said towing member is disposed in the first position.

2. The towing device of claim 1, wherein the upper portion of the towing member has a first, unextended length, and wherein the coupling means further comprises lengthening means for lengthening said upper portion to a second, extended length to thereby elevate the first attachment point and first end of the tow line when said upper portion resides in the first position such that the tow line defines a towing angle relative to the water surface when said tow line is held in tension by a water sporter being towed along the water surface, said towing angle producing a smaller downward component of force in the tow line than it would have when said upper portion is disposed in its first, unextended length.

3. The towing device of claim 2, wherein the upper portion of the towing member and the lengthening means collectively comprise a series of telescopically connected sections and a holding means for holding the telescoping sections in fixed positions with respect to each other when the upper portion is disposed in its second, extended length.

4. The towing device of claim 2, further comprising:

bracing means for interconnecting the elongate upper portion with the watercraft and thereby counteracting forces imposed against said elongate upper member by the water sporter.

5. The towing device of claim 4, wherein the bracing means comprises at least one rigid member disposed in compression between a rear portion of the elongate upper portion and a portion of the watercraft when the tow line is held in tension by the water sporter being towed along the water surface.

6. A towing device for towing a water sporter as part of a water sport activity, said device comprising:

an elongate towing member comprising an elongate base portion defining a longitudinal direction, an elongate upper portion, and coupling means for movably coupling said upper portion to said base portion in a manner sufficient to render said upper portion moveable relative to the base portion from a first position to a second, lateral position, wherein said base portion and upper portion collectively define a substantially straight line when said upper portion is disposed in said first position, and wherein said upper portion extends laterally sideways from said base portion in the second, lateral position;

first attachment means for (i) intercoupling the base portion of the towing member with an interior portion of a watercraft such that said base portion extends upwardly from said interior portion along the longitudinal direction, and (ii) positioning said base portion and upper portion such that said upper portion extends from said base portion across a side of the watercraft and terminates in a cantilevered section extending from said side of the watercraft when said upper portion resides in the second, lateral position; and second attachment means for attaching a first end of a tow line to a first attachment point on a distal end section of the towing member and pulling said tow line in tension as said tow line is held by a water sporter or water sporting device to thereby tow said water sporter or water sporting device along a water surface;

wherein the upper portion of the towing member has a first, unextended length, and wherein the base portion of the towing member further comprises a storing means for storing the upper portion of the towing means therein such that at least a majority length of said upper portion resides inside said storing means when said upper portion is disposed in its first, unextended length.

7. A towing device for towing a water sporter as part of a water sport activity, said device comprising:

an elongate towing member comprising an elongate base portion defining a longitudinal direction, an elongate upper portion, and coupling means for movably coupling said upper portion to said base portion in a manner sufficient to render said upper portion moveable relative to the base portion from a first position to a second, lateral position, wherein said base portion and upper portion collectively define a substantially straight line when said upper portion is disposed in said first position, and wherein said upper portion extends laterally sideways from said base portion in the second, lateral position;

first attachment means for (i) intercoupling the base portion of the towing member with an interior portion of a watercraft such that said base portion extends upwardly from said interior portion along the longitudinal direction, and (ii) positioning said base portion and upper portion such that said upper portion extends from said base portion across a side of the watercraft and terminates in a cantilevered section extending from said side of the watercraft when said upper portion resides in the second, lateral position; and second attachment means for attaching a first end of a tow line to a first attachment point on a distal end section of the towing member and pulling said tow line in tension as said tow line is held by a water sporter or water sporting device to thereby tow said water sporter or water sporting device along a water surface;

wherein the base portion comprises a first end section and wherein the upper portion of the towing member comprises an opposing second end section and a plurality of mid-sections, and wherein the coupling means further comprises means for movably coupling the sections to each other in series in a manner sufficient to render said mid-sections and second end section moveable relative to said first end section from a first, straight position to a second, angled position, wherein said mid-sections and second end section collectively define a substantially straight line when disposed in said first, straight position, and wherein said mid-sections and second end section collectively extend sideways from the first end section and define first and second non-straight angles in substantially a horizontal dimension when disposed in the second, angled position.

8. The towing device of claim 1, further comprising third attachment means disposed on a mid-section of the upper portion of the towing member for securing said mid-section to the side of the watercraft to thereby inhibit movement of the upper portion of the towing member with respect to the watercraft.

9. The towing device of claim 1, wherein the elongate upper portion of the towing member terminates in a distal end section coupled to a mid-section of said upper portion, said distal end section being at least as wide as the mid-section coupled to said distal end section.

10. The towing device of claim 9, wherein the distal end section is wider than the mid-section coupled to said distal end section.

11. A towing device for towing a tow line as part of a water sport activity, said towing device comprising:

a towing means for pulling a tow line in tension as said tow line is held by a water sporter or water sporting device and towing said water sporter or water sporting device along a water surface, said towing means having a first, unextended length defining a longitudinal direction;

first attachment means for intercoupling the towing means to an interior portion of a watercraft such that said towing means extends substantially vertically from said interior location along its longitudinal direction;

second attachment means for attaching a first end of the tow line to a first attachment point on the towing means such that said tow line defines a first towing angle relative to the water surface when said tow line is held in tension by said water sporter; and lengthening means for lengthening the towing means to a second, extended length to thereby elevate the first attachment point and first end of the tow line and thereby substantially modify the towing angle to a second towing angle defined by the tow line relative to the water surface.

12. The towing device of claim 11, wherein the towing means comprises an elongate base portion defining a longitudinal direction, an elongate upper portion, and coupling means for movably coupling said upper portion to said base portion in a manner sufficient to render said upper portion moveable relative to the base portion from a first position to a second, lateral position, wherein said base portion and upper portion collectively define a substantially straight line when said upper portion is disposed in said first position, and wherein said upper portion extends laterally sideways from said base portion in the second, lateral position.

13. A towing device for towing a tow line as part of a watersport activity, said towing device comprising:

a towing means for pulling a tow line in tension as said tow line is held by a water sporter or water sporting device and towing said water sporter along a water surface, said towing means having a first, unextended length defining a longitudinal direction;

first attachment means for intercoupling the towing means to an interior portion of a watercraft such that said towing means extends upwardly from said interior location along its longitudinal direction;

second attachment means for attaching a first end of the tow line to a first attachment point on the towing means such that said tow line defines a first towing angle relative to the water surface when said two line is held in tension by said water sporter; and lengthening means for lengthening the towing means to a second, extended length to thereby elevate the first attachment point and first end of the tow line and thereby substantially modify the towing angle to a second towing angle defined by the tow line relative to the water surface;

a storing means for storing the towing means therein such that at least a majority length of said towing means resides inside said storing means when said towing means is disposed in its first, unextended length.

14. A towing device for towing a tow line as part of a watersport activity, said towing device comprising:

a towing means for pulling a tow line in tension as said tow line is held by a water sporter or water sporting device and towing said water sporter along a water surface, said towing means having a first, unextended length defining a longitudinal direction;

first attachment means for intercoupling the towing means to an interior portion of a watercraft such that said towing means extends upwardly from said interior location along its longitudinal direction;

second attachment means for attaching a first end of the tow line to a first attachment point on the towing means such that said tow line defines a first towing angle relative to the water surface when said two line is held in tension by said water sporter; and lengthening means for lengthening the towing means to a second, extended length to thereby elevate the first attachment point and first end of the tow line and thereby substantially modify the towing angle to a second towing angle defined by the tow line relative to the water surface;

wherein the towing means comprises (i) a plurality of sections including a first elongate end section defining a longitudinal direction, an opposing second end section, and a plurality of mid-sections, and (ii) coupling means for movably coupling the sections to each other in series in a manner sufficient to render said mid-sections and second end section moveable relative to said first end section from a first, straight position to a second, angled position, wherein said mid-sections and second end section collectively define a substantially straight line when disposed in said first, straight position, and wherein said mid-sections and second end section collectively extend sideways from the first end section and define first and second non-straight angles in substantially a horizontal dimension when disposed in the second, angled position.

15. The towing device of claim 11, further comprising:

third attachment means disposed on a mid-section of the towing means for securing said mid-section to a side of the watercraft to thereby inhibit movement of the towing means with respect to the watercraft.

16. The towing device of claim 11, wherein the towing means and the lengthening means collectively comprise a series of telescopically connected sections and a holding means for holding the sections in fixed positions with respect to each other when the towing means is disposed in its second, extended length.

17. The towing device of claim 11, further comprising:

bracing means for interconnecting the towing means with the watercraft and thereby counteracting forces and moments imposed against said towing means by the water sporter.

18. The towing device of claim 17, wherein the bracing means comprises at least one rigid member disposed in compression between a portion of the towing means and a portion of the watercraft when the tow line is held in tension by the water sporter being towed along the water surface.

19. A towing device for towing a water sporter as part of a water sporting activity, said towing device comprising:

a towing means for towing a water sporter along a water surface, said towing means including (i) an elongate member having a first, unextended length defining a longitudinal direction, and (ii) lengthening means for lengthening the elongate member to a second, extended length;

a storing means for storing the elongate member therein such that at least a majority length of said elongate member resides inside said storing means when said elongate member is disposed in its first, unextended length, said storing means having a bottom;

first attachment means for securing the bottom of the storing means to an interior portion of a watercraft such that the elongate member stored in the storing means extends upwardly along its longitudinal direction; and second attachment means for attaching a first end of the tow line to a first attachment point on the towing means and pulling said tow line in tension as said tow line is held by a water sporter to thereby tow said water sporter along a water surface such that (i) said tow line defines a first towing angle relative to the water surface when said elongate member is disposed in its first, unextended length, and (ii) said tow line defines a second, substantially modified towing angle relative to said water surface when the elongate member is lengthened to the second, extended length, said first attachment point and first end of the tow line being elevated when the elongate member is lengthened to the second, extended length.

20. The towing device of claim 19, wherein the elongate member comprises an elongate base portion defining a longitudinal direction, an elongate upper portion, and coupling means for movably coupling said upper portion to said base portion in a manner sufficient to render said upper portion moveable relative to the base portion from a first position to a second, lateral position, wherein said base portion and upper portion collectively define a substantially straight line when said upper portion is disposed in said first position, and wherein said upper portion extends laterally sideways from said base portion in the second, lateral position.

21. The towing device of claim 19, wherein the elongate member comprises (i) a plurality of sections including a first elongate end section defining a longitudinal direction, an opposing second end section, and a plurality of mid-sections, and (ii) coupling means for movably coupling the sections to each other in series in a manner sufficient to render said mid-sections and second end section moveable relative to said first end section from a first, straight position to a second, angled position, wherein said mid-sections and second end section collectively define a substantially straight line when disposed in said first, straight position, and wherein said mid-sections and second end section collectively extend sideways from the first end section and define first and second non-straight angles in substantially a horizontal dimension when disposed in the second, angled position.

22. The towing device of claim 19, further comprising:

third attachment means disposed on a mid-section of the towing means for securing said mid-section to a side of the watercraft to thereby prevent forward and backward movement of the towing means with respect to the watercraft.

23. A towing device for towing a water sporter as part of a water sporting activity, said device comprising:

an elongate towing member comprising (i) a plurality of sections including a first elongate end section defining a longitudinal direction, an opposing second end section, and a plurality of mid-sections, and (ii) coupling means for movably coupling the sections to each other in series in a manner sufficient to render said mid-sections and second end section moveable relative to said first end section from a first, straight position to a second, angled position, wherein said mid-sections and second end section collectively define a substantially straight line when disposed in said first, straight position, and wherein said mid-sections and second end section collectively extend sideways from the first end section and define first and second non-straight angles in substantially a horizontal dimension when disposed in the second, angled position; and first attachment means for (i) securing the first end section of the towing member to an interior portion of a watercraft such that said first end section extends upwardly along its longitudinal direction and (ii) positioning said first end section sufficiently to cause the opposing second end section to extend across a side of the watercraft and terminate in a cantilevered orientation from said side.

24. The towing device of claim 23, further comprising:

second attachment means for attaching a first end of a tow line to a first attachment point on the second end section of the towing member and pulling said tow line in tension as said tow line is held by a water sporter to thereby tow said water sporter along a water surface.

25. The towing device of claim 23, further comprising:

length-adjusting means for selectively (i) lengthening the elongate towing member from a first, unextended length to a second, extended length and (i) retracting the elongate towing member from the second, extended length to the first, unextended length.

26. The towing device of claim 23, further comprising:

third attachment means disposed on one of the mid-sections for securing said mid-section to a side of the watercraft to thereby inhibit movement of the towing member with respect to the watercraft.

27. The towing device of claim 23, wherein the second end section is disposed in a noncollinear and parallel orientation with respect to the first end section when the mid-sections and second end section are disposed in the second, angled position.

28. A towing device for towing a water sporter as part of a waterskiing activity, said towing device comprising:

an elongate support member defining a longitudinal direction;

an elongate towing member having a first, unextended length;

means for connecting the elongate towing member to the elongate support member and positioning said towing member to extend laterally sideways from the support member toward a side of the watercraft;

first attachment means for (i) attaching the support member to an interior portion of a watercraft such that said support member extends upwardly from said interior portion along its longitudinal direction and (ii) positioning said support member sufficiently to cause the opposing second end section to extend across a side of the watercraft and terminate in a cantilevered orientation from said side;

lengthening means for lengthening the towing member to a second, extended length to thereby move the first attachment point further away from the support member such that said towing member extends across a side of the watercraft and terminates in a cantilevered section extending from said side of the watercraft, wherein the lengthening means further comprises means for retracting the towing member to a reduced length; and storing means for storing the towing member therein such that a majority length of said towing member resides inside said storing means when said towing member is disposed in a reduced length.

29. The towing device of claim 28, further comprising:

second attachment means for attaching a first end of a tow line to a first attachment point on the towing member and pulling said tow line in tension as said tow line is held by a water sporter to thereby tow said water sporter along a water surface.

30. The towing device of claim 28, wherein the elongate support member terminates in a distal end section coupled to a mid-section of the support member, said distal end section being at least as wide as said mid-section.

31. The towing device of claim 30, wherein the distal end section is wider than the mid-section coupled to said distal end section.

32. A method of towing a water sporter as part of a water sporting activity, said method comprising the steps of:

(a) attaching an elongate support member to an interior portion of a watercraft such that said support member extends upwardly in a longitudinal direction;

(b) attaching a lateral towing member to said elongate support member and positioning said support member and said towing member such that said towing member extends sideways from said support member and across a side of the watercraft and terminates in a cantilevered section;

(c) securing the lateral towing member to the side of the watercraft to thereby inhibit movement of said lateral towing member with respect to the watercraft;

(d) attaching a first end of a tow line to a first attachment point on the cantilevered section of the towing member and pulling said tow line in tension as said tow line is held by a water sporter to thereby tow said water sporter along a water surface;

(e) grasping the cantilevered section with one's hands for support.

33. The method of claim 32, further comprising the step of:

(f) selectively extending and retracting the towing member.

34. A method of towing a water sporter as part of a water sporting activity, said method comprising the steps of:

(a) attaching an elongate support member to an interior portion of a watercraft such that said support member extends upwardly in a longitudinal direction;

(b) attaching a lateral towing member to said elongate support member and positioning said support member and said towing member such that said towing member extends sideways from said support member and across a side of the watercraft and terminates in a cantilevered section;

(c) securing the lateral towing member to the side of the watercraft to thereby inhibit movement of said lateral towing member with respect to the watercraft;

(d) attaching a first end of a tow line to a first attachment point on the cantilevered section of the towing member and pulling said tow line in tension as said tow line is held by a water sporter to thereby tow said water sporter along a water surface;

(e) grasping the cantilevered section with one's hands for support;

(f) retracting the towing member to a reduced length and storing said towing member inside a storage means disposed around the support member such that a majority length of said towing member resides inside said storing means when said towing member is disposed in said reduced length.

35. A towing device for towing a water sporter as part of a water sporting activity, said device comprising:

an elongate towing member comprising an elongate base portion defining a longitudinal direction, an elongate upper portion, and coupling means for movably coupling said upper portion to said base portion in a manner sufficient to render said upper portion moveable relative to the base portion from a first position to a second, lateral position, wherein said base portion and upper portion collectively define a generally straight body when said upper portion is disposed in said first position, and wherein said upper portion extends laterally sideways from said base portion in the second, lateral position;

first attachment means for (i) intercoupling the base portion of the towing member with an interior portion of a watercraft such that said base portion extends upwardly from said interior portion along the longitudinal direction, and (ii) positioning said base portion and upper portion such that said upper portion extends from said base portion across a side of the watercraft and terminates in a cantilevered section extending from said side of the watercraft when said upper portion resides in the second, lateral position;

second attachment means for attaching a first end of a tow line to a first attachment point on a distal end section of the towing member and pulling said tow line in tension as said tow line is held by a water sporter to thereby tow said water sporter along a water surface;

third attachment means disposed on a mid-section of the upper portion of the towing member for securing said mid-section to the side of the watercraft when said upper portion is disposed in the second, lateral position to thereby inhibit movement of the upper portion of the towing member with respect to the watercraft; and bracing means for interconnecting the elongate upper portion with the watercraft and thereby counteracting forces imposed against said elongate upper member by the water sporter when said upper portion is disposed in the first position, said bracing means comprising at least one rigid member disposed in compression between a rear portion of the elongate upper portion and a portion of the watercraft when the tow line is held in tension by the water sporter being towed along the water surface;

wherein the upper portion of the towing member has a first, unextended length, and wherein the coupling means further comprises lengthening means for lengthening said upper portion to a second, extended length to thereby elevate the first attachment point and first end of the tow line when said upper portion resides in the first position such that the tow line defines a towing angle relative to the water surface when said tow line is held in tension by a water sporter being towed along the water surface, said towing angle having a smaller downward component than it would have when said upper portion is disposed in its first, unextended length;

wherein the base portion of the towing member further comprises a one-piece, unitary hollow storing means for storing the upper portion of the towing means therein such that at least a majority length of said upper portion resides inside said storing means when said upper portion is disposed in its first, unextended length;

wherein the upper portion of the towing member and the lengthening means collectively comprise a series of telescopically connected telescoping sections and a holding means for holding the telescoping sections in fixed positions with respect to each other when the upper portion is disposed in its second, extended length.

36. The towing device of claim 35, wherein the base portion comprises a first end section and wherein the upper portion of the towing member comprises an opposing second end section and a plurality of mid-sections, and wherein the coupling means further comprises means for movably coupling the sections to each other in series in a manner sufficient to render said mid-sections and second end section moveable relative to said first end section from a first, straight position to a second, angled position, wherein said mid-sections and second end section collectively define a substantially straight line when disposed in said first, straight position, and wherein said mid-sections and second end section collectively extend sideways from the first end section and define first and second non-straight angles in substantially a horizontal dimension when disposed in the second, angled position.

37. A method of towing a water sporter as part of a water sporting activity, said method comprising the steps of:

(a) attaching an elongate towing member having a first, unextended length defining a longitudinal direction to an interior portion of a watercraft such that said towing member extends substantially vertically in the longitudinal direction, said towing member including a first attachment point thereon;

(b) attaching a first end of a tow line to the first attachment point on the towing member;

(c) advancing the watercraft along a water surface to thereby pull said tow line in tension as said tow line is held by a water sporter and tow said water sporter along the water surface; and (d) lengthening the elongate towing member in the longitudinal direction to a second, extended length to thereby elevate the first attachment point such that the tow line defines an angle relative to the water surface when said tow line is held in tension by a water sporter or water sporting device being towed along the water surface, said angle producing a smaller downward component of force in the tow line than it would have when said elongate towing member is disposed in its first, unextended length.

38. A method of towing a water sporter as part of a water sporting activity, said method comprising the steps of:

(a) attaching an elongate towing member having a first, unextended length defining a longitudinal direction to an interior portion of a watercraft such that said towing member extends upwardly in the longitudinal direction, said towing member including a first attachment point thereon;

(b) attaching a first end of a tow line to the first attachment point on the towing member;

(c) advancing the watercraft along a water surface to thereby pull said tow line in tension as said tow line is held by a water sporter and tow said water sporter along the water surface;

(d) lengthening the elongate towing member in the longitudinal direction to a second, extended length to thereby elevate the first attachment point such that the tow line defines an angle relative to the water surface when said tow line is held in tension by a water sporter or water sporting device being towed along the water surface, said angle producing a smaller downward component of force in the tow line than it would have when said elongate towing member is disposed in its first, unextended length; and (e) securing a one-piece, unitary hollow storage housing to an interior portion of the watercraft;

(f) retracting the elongate towing member back to the first, unextended length and storing said elongate towing member inside the storage housing.

39. A method of towing a water sporter as part of a water sporting activity, said method comprising the steps of:

(a) attaching an elongate support member defining a longitudinal direction to an interior portion of a watercraft such that said support member extends upwardly in the longitudinal direction;

(b) attaching a towing member to the support member, said towing member including a first attachment point thereon;

(c) attaching a first end of a tow line to the first attachment point on the towing member;

(d) advancing the watercraft along a water surface to thereby pull said tow line in tension as said tow line is held by a water sporter and tow said water sporter along the water surface;

(e) lengthening the elongate towing member to a second, extended length to thereby move the first attachment point further away from the support member such that said towing member extends across a side of the watercraft and terminates in a cantilevered section extending from said side of the watercraft; and (f) retracting the towing member to a reduced length and storing said towing member inside a storage means disposed around the support member such that a majority length of said towing member resides inside said storing means when said towing member is disposed in said reduced length.

40. A towing device for towing a water sporter as part of a waterskiing activity, said device comprising:

a base member attachable to an interior portion of a watercraft to extend generally upwardly therefrom to a point at least as high as sides of the watercraft; and a towing member attachable to the base member and being manipulable between a first, generally vertically-extending orientation in which a water sporter or water sporting device is towed by said towing member and a second, laterally-extending orientation such that said towing member extends sideways relative to the base member when disposed in the second orientation and terminates in a cantilevered section extending from a side of the watercraft.

* * * * *